US008333303B2

(12) United States Patent
Dubach

(10) Patent No.: US 8,333,303 B2
(45) Date of Patent: Dec. 18, 2012

(54) METERING DEVICE

(75) Inventor: Werner F. Dubach, Maur (CH)

(73) Assignee: Kisling AG, Tagelswangen (CH)

( * ) Notice: Subject to any disclaimer, the term of this patent is extended or adjusted under 35 U.S.C. 154(b) by 529 days.

(21) Appl. No.: 12/598,398

(22) PCT Filed: Apr. 30, 2008

(86) PCT No.: PCT/CH2008/000198

§ 371 (c)(1),
(2), (4) Date: Oct. 30, 2009

(87) PCT Pub. No.: WO2008/131578

PCT Pub. Date: Nov. 6, 2008

(65) Prior Publication Data

US 2010/0140293 A1 Jun. 10, 2010

(30) Foreign Application Priority Data

Apr. 30, 2007 (CH) ..... 705/07

(51) Int. Cl.
*B65D 37/00* (2006.01)

(52) U.S. Cl. ..... 222/214; 222/95

(58) Field of Classification Search ..... 222/214, 222/95–97, 105, 472, 392, 465, 1, 465.1, 222/71, 103
See application file for complete search history.

(56) References Cited

U.S. PATENT DOCUMENTS

| | | | | |
|---|---|---|---|---|
| 2,644,613 | A * | 7/1953 | Pepin | 222/103 |
| 4,326,647 | A * | 4/1982 | Pool | 222/103 |
| D273,257 | S * | 4/1984 | Barrera | D6/530 |
| 5,909,828 | A * | 6/1999 | Salisbury | 222/103 |
| 6,315,165 | B1 * | 11/2001 | Regan | 222/103 |
| 6,669,055 | B1 * | 12/2003 | Coleman et al. | 222/103 |
| 7,516,872 | B2 * | 4/2009 | Boone et al. | 222/212 |
| 2007/0095853 | A1 * | 5/2007 | Bonney et al. | 222/21 |

* cited by examiner

*Primary Examiner* — Lien Ngo
(74) *Attorney, Agent, or Firm* — Janet Sleath; Speckman Law Group PLLC

(57) ABSTRACT

Metering devices, particularly for adhesives and sealants, that can be placed on a flexible container by means of an adapted ring, a lever being connected to the ring, and pressing against the container, are known. The invention relates to a metering device whereon the lever is connected to the ring via a deformable spring plate. A push button is formed onto the lever as an extension. Thus, the one-piece metering device is inexpensive and can be produced without needing to be assembled.

12 Claims, 3 Drawing Sheets

METERING DEVICE

REFERENCE TO RELATED APPLICATIONS

This application is the US national phase entry of International Patent Application No. PCT/CH2008/000198, filed Apr. 30, 2008, which claims priority to Swiss Patent Application No. 705/07, filed Apr. 30, 2007.

FIELD OF THE INVENTION

The present invention pertains to a metering device for being attached to a container with a bottom and a container neck that is formed above a container shoulder and to which a closure with a discharge nozzle can be attached.

BACKGROUND OF THE INVENTION

Metering devices are needed, in particular, for adhesives, cyanoacrylates, instant adhesives or anaerobic adhesives and sealants. These are sold in bottle-shaped containers, wherein only minimal quantities of all these adhesives and sealants are dispensed in a metered fashion and the containers, namely plastic bottles, accordingly are relatively small. The container needs to be slightly squeezed in order to dispense the corresponding substance from a nozzle in a metered fashion. Particularly adhesives and sealants are frequently semiliquid or have a low viscosity and therefore do not flow out of the container themselves. However, certain adhesives also need to be stored in such a way that practically no oxygen admission can occur. Consequently, the plastic bottles need to be made of HDPE (High Density Polyethylene) and this material needs to have a corresponding hardness. However, this complicates the metering by exerting pressure upon the container.

It would be particularly desirable to use relatively long, pin-shaped bottles, but the smaller the diameter of the container, the more difficult its deformation for realizing the metering such that this situation represents an absolute dilemma. In addition, the container needs to be provided with a metering device in order to even allow a sensible metered dispensing of the adhesive.

U.S. Pat. No. 4,771,769 already discloses a metering device, in which a relatively small bottle can be inserted into a device that features a body, in which bottle is situated, wherein this body features a pressure lever that is coupled to the wall and presses on the edge of the bottle bottom. This solution practically is only suitable for soft containers because plastic bottles of a hard plastic, particularly a HDPE, practically cannot be deformed in the region of the particularly large wall thickness at the transition from the bottom to the container wall. In order to position the bottle in the metering device, it is furthermore necessary to unscrew the cap, to insert the open container into the device and to subsequently reattach the cap so as to fix the bottle in the device. This procedure would be completely unsuitable for a cyanoacrylate adhesive and an accidental spill could lead to substantial damages.

A much more cost-efficient variation is disclosed in WO-2004/013009-A. This publication discloses a simple and inexpensive metering device that makes it possible to dispense a liquid drop by drop. Although this document describes a number of exemplary embodiments, only one embodiment is relevant in this context, wherein this embodiment proposes a loop-shaped plastic loop that is aligned parallel to the longitudinal bottle axis and encompasses the container neck. The loop is separated in the bottom region of the bottle and adjoins the bottom of the bottle at this location, wherein the loop subsequently extends upward to the bottle neck while adjoining the container wall, over the bottle while lying on the container shoulder and then downward on the diametrically opposite bottle wall region in the form of a certain moulded bend. The bend in the region of the bottle shoulder lies on the container wall and a lever downwardly extends from the shoulder to the bottom in an angled fashion in order to once again join the loop extending underneath the bottle bottom after being bent one more time. Such a device also has the disadvantage that the pressure is excerpted exactly at the location, at which the bottle has a particularly high rigidity, namely in the region of the shoulder. Furthermore, this device is only suitable for occasional use and the device essentially needs to be detached from the bottle in order to store the container.

A metering device according to the preamble of Claim 1 is also known from U.S. Pat. No. 4,773,898. This publication pertains to a veterinary device that serves for administering medications to animals. In this case, a lever is coupled to a ring that is attached to the bottle by means of a hinge, wherein said lever has a curvature that is directed toward the bottle and serves for exerting pressure.

SUMMARY OF THE INVENTION

The present invention is based on the objective of developing a metering device that is suitable, in particular, for elongated cylindrical containers, particularly pin-shaped containers, and eliminates the disadvantages of the described solutions, wherein said metering device can be inexpensively manufactured in one piece without hinges.

This objective is attained with a metering device that can be attached to a container with a bottom and a container neck that is formed above a container shoulder and to which a closure with a discharge nozzle can be attached, wherein the metering metering device comprises a ring that is adapted to the container and to which a one-armed lever is coupled that extends from the ring to the container neck and features at least one depressing element that is directed toward the container and can be centrally pressed against the container wall between the container bottom and the container neck in order to deform the container, and wherein the lever is integrally connected to the ring by means of a deformable spring plate and the depressing element is moulded on the lever in the form of a depressing extension. In certain embodiments, the lever continuously extends in alignment with the spring plate over at least one section. In certain embodiments, the lever includes reinforcing ribs extending in planes that lie parallel to the longitudinal axis of the container. In related embodiments, the reinforcing ribs extend no further than the center of the spring in the axial direction. In other embodiments, the lever is provided with a peripheral side wall that is directed toward the container for reinforcement purposes. In certain embodiments, the at least one depressing extension is moulded on at least one reinforcing rib, preferably a central reinforcing rib. In further embodiments, the ring is realized in a double-walled fashion and the inner ring wall of the ring reversibly or irreversibly encompasses the container in a form-fitting fashion in the region near the bottom while the outer ring wall conically widens toward the bottom. In other embodiments, the ring is realized in a double-walled fashion and the lever is integrally connected to the outer ring wall by means of the spring plate. In yet further embodiments, the inner ring wall of the ring is provided with irreversible form-fitting means and the container features at least one recess, into which the form-fitting means engage. In certain embodiments, the irreversible form-fitting means consist of spring tabs. In other embodiments, the container features a recess in the form of an annular groove that is arranged in the region near the bottom.

BRIEF DESCRIPTION OF THE DRAWINGS

One preferred embodiment is illustrated in the enclosed drawings and described in greater detail below. In these drawings.

DETAILED DESCRIPTION

Figure 1:
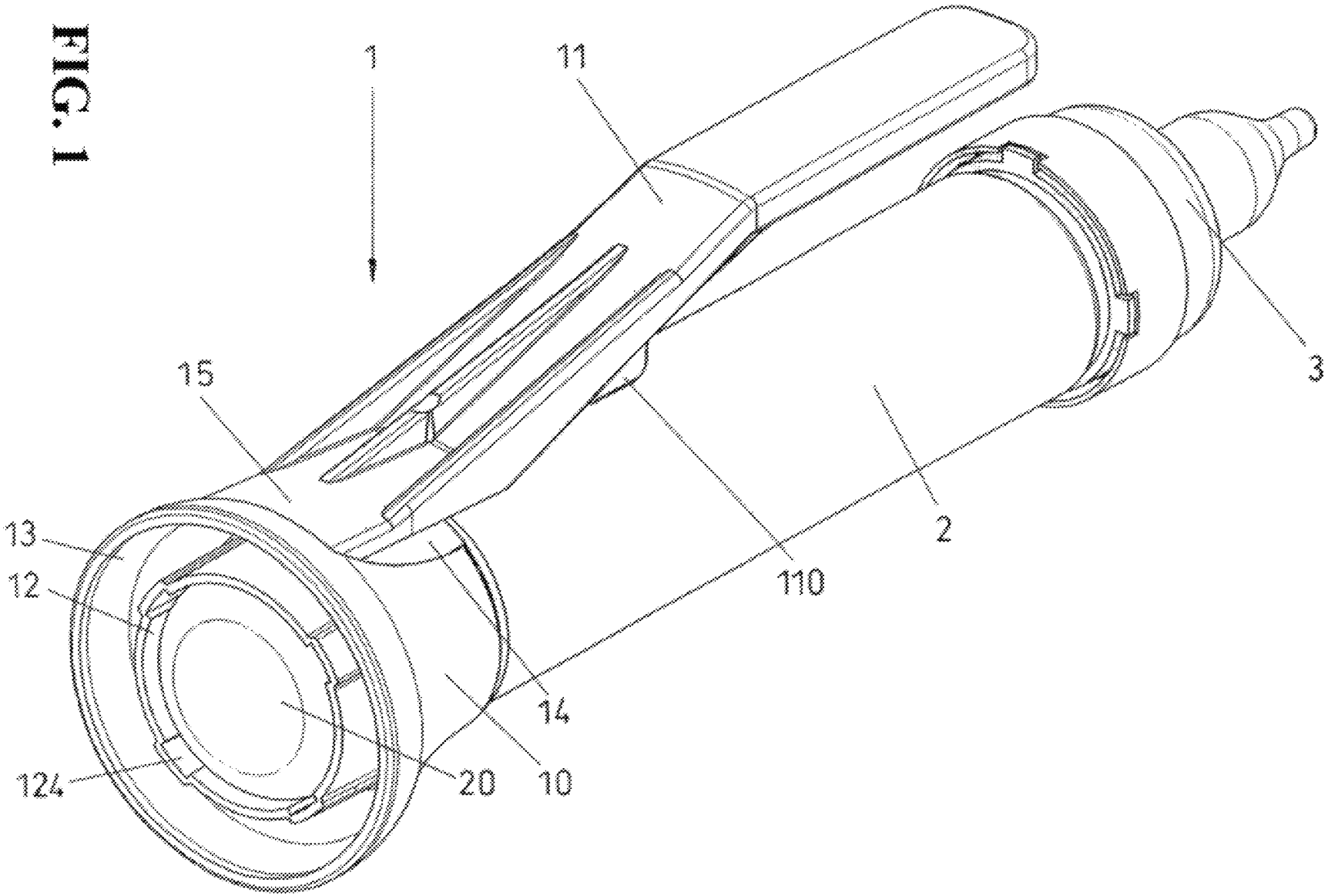
FIG. 1 shows a perspective representation of the metering device that is attached to an elongated, pin-shaped container, namely viewed in the direction of the base of the container and the metering device, respectively.

The figures respectively show three different elements. The reference symbol 1 identifies the actual metering device while the container is identified by the reference symbol 2 and the closure is identified by the reference symbol 3. The container 2 is illustrated most clearly in the axial longitudinal section according to FIG. 3. The container 2 features a bottom 20 that is connected to a cylindrical container wall 21 that transforms into the container neck 23 in the form of a shoulder 22. In this case, the shoulder 22 and the container neck 23 are realized with particularly thick walls while the container wall 21 and the bottom 22 are thinner than the aforementioned regions. In the example shown, the container 2 consists of a thin elongated bottle that practically has the shape of a pin. The example shown is approximately illustrated on a scale of 2:1. The actual size of the container 2 approximately corresponds to that of a fountain pen. Although this preferred exemplary embodiment is illustrated in the figures, the shape of the container itself is not crucial. Although an elongated, cylindrical container is certainly advantageous with respect to its handling, the container naturally may also have, for example, a shape other than cylindrical, wherein the container may also be realized shorter or bulgy or with an oval cross-section. However, the lever of the metering device described below may, if so required, have to be adapted to the container shape, but a person skilled in the art is quite familiar with such an adaptation.

The closure naturally is adequately adapted for dispensing the smallest possible quantity in a correctly metered fashion. The closure 3 accordingly is designed such that it opens into a dispensing nozzle. Since the design of the closure 3 is not important for the invention, but rather merely optimized for dispensing the adhesive, the exact design of the closure 3 is not discussed.

Figure 2:
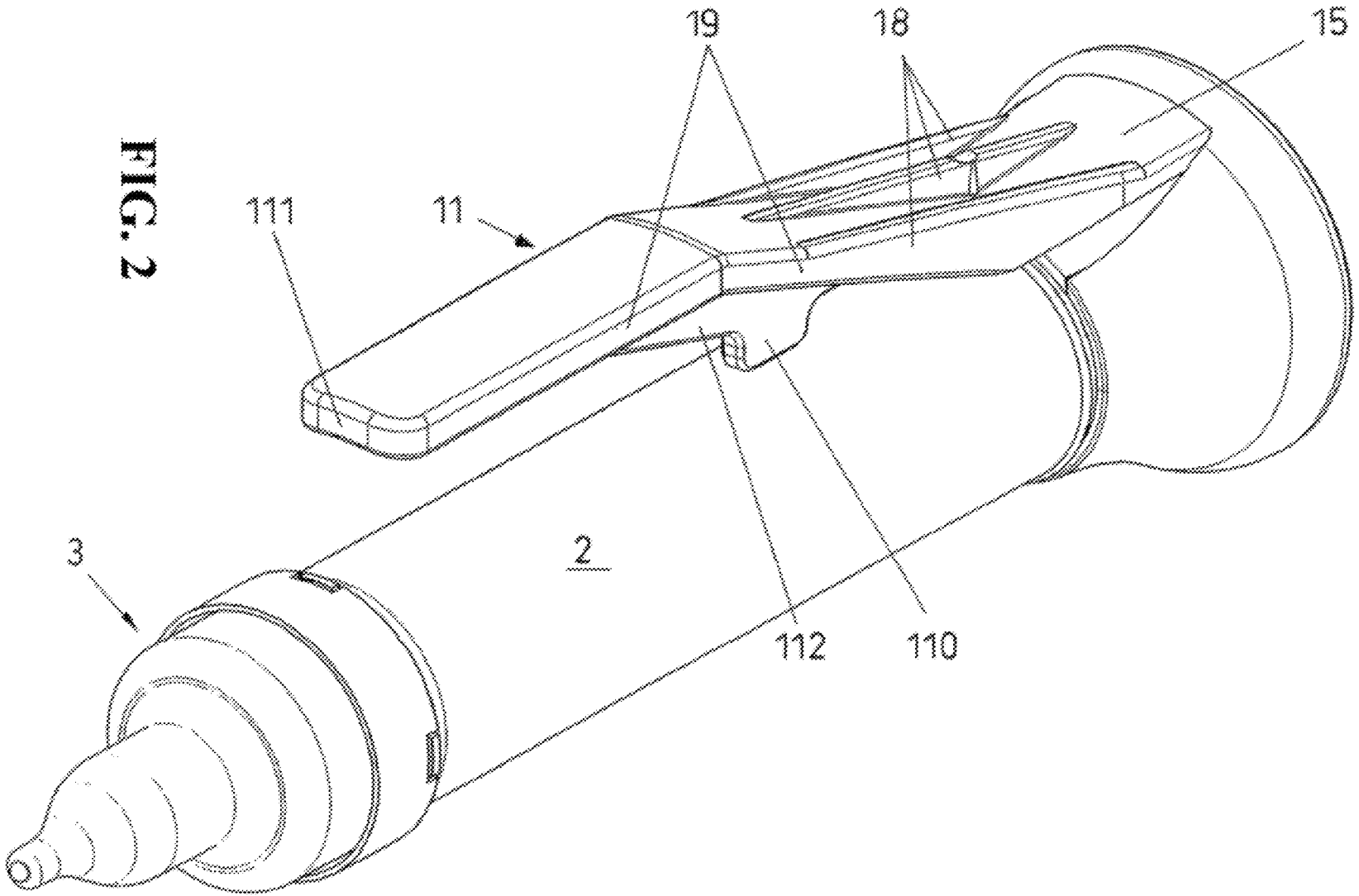
FIG. 2 shows the same metering device on the same container viewed in the direction of the nozzle-shaped outlet.
Figure 3:
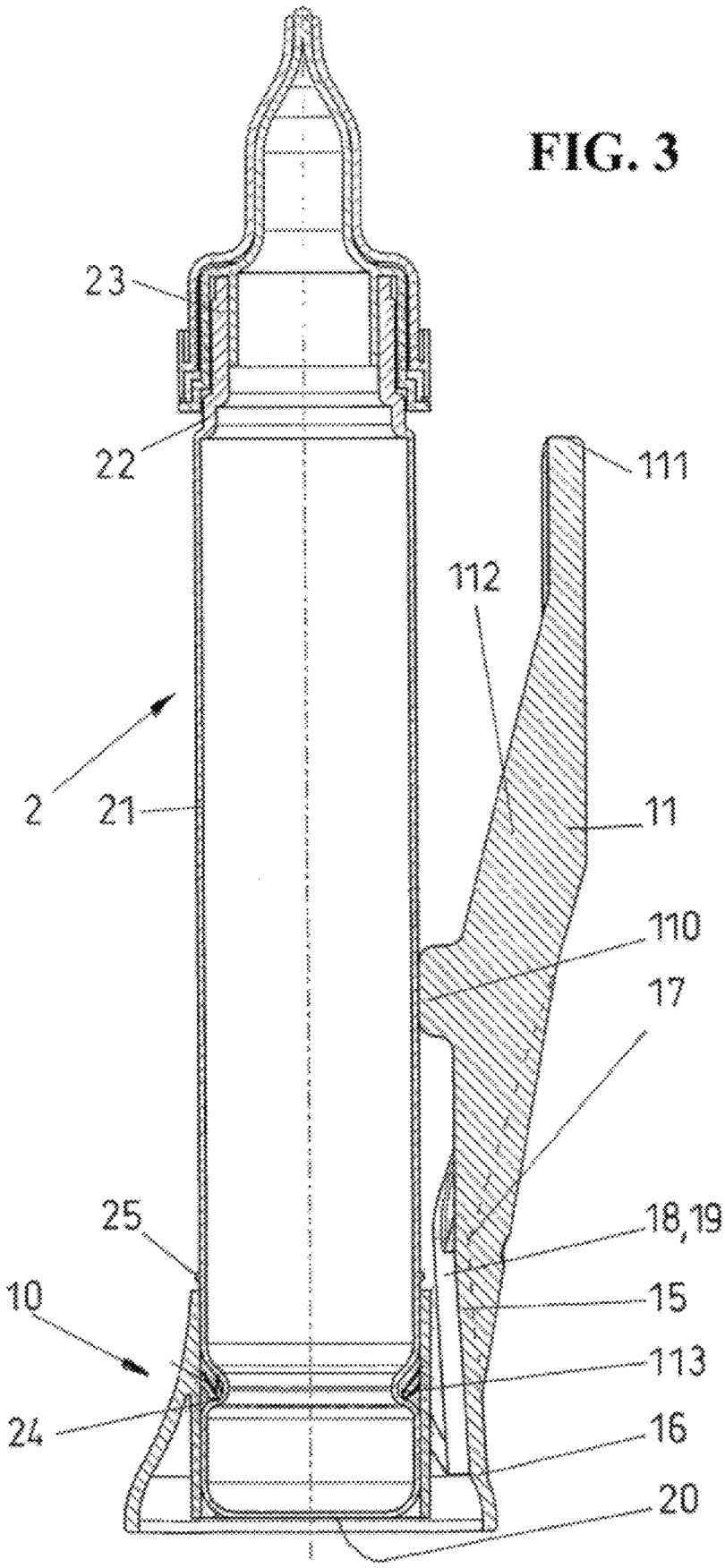
FIG. 3 shows a central vertical section through the metering device and the container, to which it is attached.

The metering device 1 essentially consists of two parts, namely of a ring 10 that is adapted to the container and a lever 11 that is connected to the ring 10 and extends from the ring 10 in the direction of the container neck 23, wherein the lever and the ring 10 may also be integrally connected as shown in FIGS. 1-3.

The ring 10 may, in principle, be relatively thin-walled and does not have to be realized with a round shape if the bottom of the container 2 is not round. However, the ring 10 needs to be designed such that it can be attached to the container 2, particularly in the region of its bottom 20. If the container 2 has an oval bottom, the ring 10 consequently also needs to have a correspondingly oval shape. In the example shown, however, the container 2 has the shape of a circular cylinder and the ring therefore is also realized with a circular-cylindrical shape.

Since the container 2 practically has the shape of a pin in the embodiment shown and the bottom 20 therefore would only form a relatively small base, the ring 10 is realized in a double-walled fashion, wherein an inner ring wall 12 directly encompasses the container 2 in a positive and non-positive fashion in the region of the bottom. An outer ring wall 13 extends around the inner ring wall 12 at a certain distance therefrom at least in the bottom region and is realized conically such that the inner ring wall 12 and the outer ring wall 13 coincide in the upper region. The outer ring wall 13 naturally may also be designed such that it extends outward in a cambered fashion.

In the example shown, the lever 11 is integrally moulded on the outer ring wall 13. In the region between the top and the vicinity of the lower edge, the outer ring wall 13 features lateral recesses 14 to both sides of the lever 11. This makes it possible to pivot the lever 11 by slightly deforming the outer ring wall 13. The ability to pivot the lever is improved by moulding a spring plate 15 that directly transforms into the lever 11 directly on the ring 13. The spring plate 15 extends from the connecting point 16 to a first bending point 17 approximately parallel to a tangential plane of the container wall. Elevated reinforcing ribs 18 are provided in the region of the bending point. In this case, the two outer reinforcing ribs 18 are aligned with the peripheral side wall 19 of the lever 11. The side wall 19 extends over the entire length of the lever 11 on its sides and front faces. The lever 11 therefore is provided with a peripheral wall that is directed toward the container 2 and serves for reinforcing the lever. Except for the region of the spring plate, the lever 11 therefore is reinforced at all locations such that it is resistant to bending except for the region of the spring plate 15.

In addition, the lever 11 is provided with a depressing extension 110 that lies on the wall 21 of the container 2.

The depressing extension 110 may, in principle, be arranged on the lever 11 at any location, but it is preferred to arrange the pressing extension approximately in the center between the connecting point 16 and the lever end 111. The closer the pressing extension 110 is shifted to the lever and 111, the higher the force to be exerted, and the closer the pressing extension is arranged to the ring 10, the lower the force required for pressing the depressing extension 110 against the container wall 21 in order to deform the container wall, but the depth of the impression also becomes smaller as the distance between the depressing extension 110 and the ring 10 decreases. Consequently, the depressing extension should be arranged approximately in the center between the lower edge of the ring 10 and the lever end 111.

In the example shown, the depressing extension 110 is moulded on a central reinforcing rib 112 that is centrally moulded on the underside of the lever between the peripheral outer walls 19. The elevated reinforcing ribs 18 point away from the wall of the container, but at least the one central reinforcing rib 112 extends on the underside of the lever and is directed toward the container 2.

FIG. 3 shows that the container features a recess 24 in the region near the bottom, wherein this recess is realized in the form of a peripheral contraction 24 in this case. Flexible tabs 113 engage into this recess 24 and thusly prevent the metering device 1 from being pulled off the container 2.

All reinforcing ribs 18 and 112 extend in planes that lie parallel to the latitudinal axis of the container. Although the reinforcing ribs may, in principle, have any length, it is advantageous that they do not extend beyond the center of the spring plate 15 such that the spring plate 15 is not also completely reinforced, but rather features a region that can serve for achieving the desired deformation. This deformable region in effect forms a hinge-free joint.

The inventive metering device 1 can be realized in an extremely inexpensive fashion and therefore used as a disposable element that is directly attached to the container at the factory. In this respect, it is naturally desirable that this disposable metering device is not misused for other purposes. In addition to the irreversible connection produced by means of the form-fitting means 113, the wall 21 of the container 2 may also be provided with an annular bead 25 that makes it impossible to pull off the metering device in the direction of the container neck.

Since the containers 2 usually consist of blow-molded plastic containers and these blow-molded containers have certain tolerances with respect to their diameter, it may be sensible to realize the ring 10 and, particularly if the ring 10 is double-walled, the inner ring wall 12 with indentations 124 that are arranged at regular distances, wherein these indentations allow a certain elastic deformation of the ring and simultaneously create space for the deformed container wall 21 in the region 20 near the bottom. If such indentations 124 are provided, the form-fitting means 113 that are usually realized in the form of spring tabs are preferably also arranged in these indentations 124.

LIST OF REFERENCE SYMBOLS

1 Metering device
2 Container
3 Closure with discharge nozzle
10 Ring
11 Lever
11' Lever
12 Inner ring wall
13 Outer ring wall
14 Lateral recess
15 Spring plate
16 Connecting point
17 Bending point
18 Elevated reinforcing ribs
19 Side wall
20 Region near bottom, bottom
21 Container wall
22 Shoulder
23 Container neck
24 Recess
25 Annular bead
110 Depressing extension
111 Lever end
112 Central reinforcing rib
113 Spring tabs, form-fitting means
120 Bearing block
121 Bearing axis
122 Leaf spring
123 Bearing journal
124 Indentations

The invention claimed is:

1. A metering device capable of being attached to a container with a bottom and a container neck that is formed above a container shoulder and to which a closure with a discharge nozzle can be attached, wherein the metering device comprises:

(a) a ring that is adapted to the container, wherein the ring is double-walled and comprises an inner ring wall that reversibly or irreversibly encompasses the container in a form-fitting fashion in a region near the container bottom and an outer ring wall that conically widens toward the container bottom;

(b) a one-armed lever that is coupled to and extends from the ring to the container neck, the lever comprising at least one depressing element that is directed toward the container and can be centrally pressed against the container wall between the container bottom and the container neck in order to deform the container, wherein the lever is integrally connected to the ring by means of a deformable spring plate and the depressing element is moulded on the lever in the form of a depressing extension.

2. The metering device according to claim 1, wherein the lever continuously extends in alignment with the spring plate over at least one section.

3. The metering device according to claim 1, wherein the lever comprises reinforcing ribs extending in planes that lie parallel to the longitudinal axis of the container.

4. The metering device according to claim 3, wherein the reinforcing ribs extend no further than the center of the spring plate in the axial direction.

5. The metering device according to claim 1, wherein the lever is provided with a peripheral side wall that is directed toward the container for reinforcement purposes.

6. The metering device according to claim 1, wherein the at least one depressing extension is moulded on at least one reinforcing rib.

7. The metering device according to claim 1, wherein the lever is integrally connected to the outer ring wall by means of the spring plate.

8. The metering device according to claim 1, wherein the inner ring wall is provided with irreversible form-fitting means that engages at least one recess in the container.

9. The metering device according to claim 8, wherein the irreversible form-fitting means are spring tabs.

10. The metering device according to claim 8, wherein the container comprises a recess in the form of an annular groove that is arranged in the region near the bottom.

11. The metering device according to claim 6, wherein the at least one reinforcing rib is a central reinforcing rib.

12. The metering device according to claim 1, wherein the lever is integrally connected to the outer ring wall by means of the spring plate.

* * * * *